US006993810B2

(12) United States Patent
Hamada

(10) Patent No.: US 6,993,810 B2
(45) Date of Patent: Feb. 7, 2006

(54) SLIDER FOR SLIDE FASTENER PROVIDED WITH AUTOMATIC STOPPER DEVICE

(75) Inventor: Yoshikazu Hamada, Toyama-ken (JP)

(73) Assignee: YKK Corporation, Tokyo (JP)

( * ) Notice: Subject to any disclaimer, the term of this patent is extended or adjusted under 35 U.S.C. 154(b) by 36 days.

(21) Appl. No.: 10/685,760

(22) Filed: Oct. 15, 2003

(65) Prior Publication Data

US 2004/0078942 A1 Apr. 29, 2004

(30) Foreign Application Priority Data

Oct. 29, 2002 (JP) ..... 2002-313760

(51) Int. Cl.
*A44B 19/30* (2006.01)

(52) U.S. Cl. ..... 24/424; 24/436; 24/422

(58) Field of Classification Search ..... 24/436, 24/424, 421, 422, 418
See application file for complete search history.

(56) References Cited

U.S. PATENT DOCUMENTS 4,123,828 A * 11/1978 Akashi ..... 24/422
4,287,646 A * 9/1981 Kanzaka ..... 24/424
4,667,376 A 5/1987 Ishii et al.
4,679,281 A * 7/1987 Ishii et al. ..... 24/422
5,664,300 A 9/1997 Mizuno
5,848,455 A * 12/1998 Ikehara et al. ..... 24/422

FOREIGN PATENT DOCUMENTS

| | | |
|---|---|---|
| GB | 853905 | 9/1957 |
| JP | 62-41608 | 10/1987 |
| JP | 2-19049 | 5/1990 |
| JP | 9-65909 | 3/1997 |

* cited by examiner

*Primary Examiner*—Robert J. Sandy
(74) *Attorney, Agent, or Firm*—Everest Intellectual Property Law Group; Michael S. Leonard

(57) ABSTRACT

A slider for slide fastener provided with an automatic stopper device which allows automatic assembly and manual assembly and holds a leaf spring in a stabilized condition, the slider having five members, that is, a body, a pull tag, a pawl member, a leaf spring and a cover. Mounting posts for attachment of the cover are provided on front and rear portions on a top face of the body. The top face of each of the mounting posts has a protrusion as a first holding portion for holding the leaf spring in which concave portions are formed in both ends. The cover to be mounted on the mounting posts has protrusions as second holding portions for holding the leaf spring at front and rear ends of the inner face of the top wall. Each of the concave portions in the leaf spring is engaged with the protrusions of the first holding portion and second holding portion with play.

13 Claims, 13 Drawing Sheets

SLIDER FOR SLIDE FASTENER PROVIDED WITH AUTOMATIC STOPPER DEVICE

BACKGROUND OF THE INVENTION

1. Field of the Invention

The invention relates to a slider for slide fastener provided with automatic stopper device, the slider being comprised of five members, that is, a body, a pull tag, a pawl member, a leaf spring and a cover. More particularly the invention relates to a slider for slide fastener having a configuration which allows the leaf spring and cover to be loaded on the slider body in a stabilized condition upon automatic assembly or manual assembly procedure.

2. Description of the Related Art

In a conventional slider provided with an automatic stopper device, which has been disclosed in, for example, Japanese Utility Model Application Publication No. 62-41608, as shown in FTC. 14, a front post and a rear post 112 (corresponding to a mounting post) for supporting a leaf spring 104 are provided on front and rear portions of atop face of an upper blade 107 of the slider body 101. Low shoulders 150 are provided on both sides of each of the front and rear posts 112 and a head 114 projected upward is provided between the shoulders 150. The surface of this head 114 is formed into a face curved downward in the forward direction at the front post 112 while in the rearward direction at the rear post 112. Then, the leaf spring 104 having cutouts 131 at both ends thereof into which the heads 114 are inserted with play is placed on the shoulders 150 between the front post 112 and the rear post 112. A cover 105 having a groove 139 formed therein which can fit to the heads 114 with mounted over the front and rear posts 112, so that the leaf spring 104 is supported by the shoulders 150 and the thick portion of the cover 105.

As shown in FIG. 15, according to another conventional example disclosed in Japanese Utility Model Application Publication No. 2-19049, a supporting piece 212 (corresponding to the rear mounting post) and a supporting portion 212 (corresponding to the front mounting post) are provided on front and rear portions of the upper blade 207 of the slider body 201. A front leaf spring supporting portion 237 and a rear leaf spring supporting portion 237 are provided at a front portion and a rear portion on an inside wall of a cover 205, respectively. The front leaf spring supporting portion 237 and the rear leaf spring supporting portion 237 are bent inward or outward so that each of the leaf spring supporting portions 237 covers the leaf spring 204 loosely when the leaf spring 204 is inserted and disposed between the front leaf spring supporting portion 237 and the rear leaf spring supporting portion 237. Then, the cover 205 is mounted on the supporting piece 212 and the supporting portion 212.

In a slider for slide fastener provided with an automatic stopper device disclosed in Japanese Patent Application Laid-Open No. 9-65909, as shown in FIG. 16, mounting posts 312 for attachment of a cover 305 are provided at front and rear portions on a top face of an upper blade 307 of a slider body 301 and a leaf spring 304 is provided between the mounting posts 312. An engaging portion 314 having a V-shaped groove 319 is provided on the top face of each of the mounting posts 312 in order to attach the leaf spring 304 on it and the leaf spring 304 is disposed on the engaging portion 314 and then, the leaf spring 304 is fixed temporarily with play by expanding the V-shaped groove 319. With this condition, the cover 305 is fixed on the body 301 such that the engaging portion 314 is covered with a covering concave portion 339 provided in an inner face of the cover 305.

In recent years, the price of the slide fastener has been declining due to market competition and therefore, to secure competitiveness in the market, reduction of manufacturing cost of the slide fastener has been demanded. For that purpose, manufacturing cost of a slider which is one of components of the slide fastener is necessary. The slider has been manufactured globally with its manufacturing centers scattered at each country and in order to produce the sliders at low cost at respective manufacturing centers, assembly thereof with automatic assembly machine is preferable because it is capable of manufacturing a large number of products effectively and generates no deflection in product quality. However, because the automatic assembly machine is expensive, manual assembly with a large man power may produce a larger amount of products at a lower cost rather than by introducing the automatic assembly machine depending on the manufacturing center.

In a well known slider as shown in FIG. 14 disclosed in the aforementioned Japanese Utility Model Application Publication No. 62-41608, a leaf spring 104 is mounted between a head 114 and a shoulder 150 provided on top faces of a front post 112 and a rear post 112 erected at front and rear portions of a body 101 and a cover 105 having a concave groove 139 which allows the head 114 to be loosely engaged in is placed from above. Thus, the position of the leaf spring 104 is unstable before the cover 105 is mounted and further, when the cover 105 is mounted, the leaf spring 104 comes into a contact with the cover 105, so that the leaf spring 104 is likely to drop from the top face of the post 112 and therefore, its manual assembly is difficult.

In a slider as shown in FIG. 15 disclosed in the aforementioned Utility Model Application Publication No. 2-19049, the leaf spring 204 is engaged in the cover 205 so that the leaf spring 204 is disposed between a front leaf spring supporting portion 237 and a rear leaf spring supporting portion 237. Then, both of the leaf spring supporting portions 237 are bent so as to cover the front and rear portions of the leaf spring 204. Thus, the leaf spring 204 is installed in the cover 205 preliminarily before it is assembled with the body 201 and therefore, the position of the leaf spring 204 is stabilized. However, in an automatic assembly machine capable of manufacturing at a high efficiency by supplying and assembling a body 201, a pull tag 202, a pawl 203, a leaf spring 204 and a cover 205 successively, when the leaf spring 204 is installed in the cover 205, the position of the cover 205 is inverted. That is, with the cover 205 turned upside down, the leaf spring 204 is inserted into the cover 205 from above and installed. A process of inverting the cover position again to restore to its original position is necessary, so that the structure of the automatic assembly machine becomes complicated. Thus, this method is not suitable for application to the automatic assembly.

Further, in a slider shown in FIG. 16 disclosed in Japanese Patent Application Laid-Open No. 9-65909, the leaf spring 304 is mounted on the mounting post 312 having an engaging portion 314 for fixing the leaf spring 304 temporarily on its top face and a covering concave portion 339 provided in an inner face of the cover 305 embraces the engaging portion 314 so as to prevent the leaf spring 304 from escaping out. Consequently, the position of the leaf spring 304 assembled on the body 301 is stabilized, thereby preventing the leaf spring 304 from dropping from the mounting post 312 when the cover 305 is mounted. However, the slider does not have a configuration which allows the leaf spring 304 to be fixed both to the cover 305 and the mounting post 312, so that it cannot meet both cases where the leaf spring 304 is fixed to the cover 305 and where the leaf spring 304 is fixed to the body 301.

SUMMARY OF THE INVENTION

An object of the invention is to provide a slider for slide fastener with an automatic stopper device, the slider comprising a body, a pull tag, a pawl member, a leaf spring and a cover, which can be assembled easily automatically or manually, while the leaf spring is maintained in a very stabilized condition, thereby ensuring a smooth operation.

In addition to the above object, another object of the invention is to provide a slider for slide fastener with an automatic stopper device, which specifies the configuration of the leaf spring and holds the leaf spring in a stabilized condition without an interference between the holding portions provided on the body and in the cover, thereby ensuring a smooth operation.

In addition to the above objects, still another object of the invention is to provide a slider for slide fastener with an automatic stopper device which holds the leaf spring of various kinds in configuration in an effective and stabilized condition by specifying the configuration of the holding portion for holding the leaf spring to be provided on the body and in the cover thereby ensuring a smooth operation.

A further object of the invention is to provide a slider for slide fastener with an automatic stopper device which holds the leaf spring in a stabilized condition such that existence of respective holding portions does not obstruct assembly of the cover with the body by specifying the relation between the holding portion to be provided on the body and the holding portion to be provided in the cover, thereby ensuring an ideal operation. A still further object of the invention is to provide a slider for slide fastener with automatic stopper device which holds the leaf spring securely in a stabilized condition without the leaf spring's escaping from the holding portion by specifying the configuration of the holding portion for holding the leaf spring on the body or in the cover. A yet still further object of the invention is to provide a slider for slide fastener with an automatic stopper device in which the body, the pull tag, the pawl member, the leaf spring and the cover can be disposed ideally.

To achieve the above-described objects, according to the invention, there is provided a slider for slide fastener provided with an automatic stopper device, the slider comprising five components including a body, a pull tag, a pawl member, a leaf spring and a cover, wherein mounting posts are provided on front and rear portions of an upper blade of the body with an interval and first holding portions for holding the leaf spring are provided on the top face of the mounting posts, second holding portions for holding the leaf spring are provided on front and rear portions of an inner face of the cover, the leaf spring is provided between the respective holding portions such that it can play freely, a pivoting shaft of the pull tag and a pawl member are interposed between the leaf spring and the upper blade and the cover is fixed on the mounting posts from above.

Preferably, the leaf spring to be provided on the body is a rectangular plate and has cut-out concave portions on both ends for accommodating each of the first holding portions provided on the body and each of the second holding portions provided in the cover. Alternatively, it is permissible to form a convex portion for being accommodated in both the first holding portion and the second holding portion.

The first holding portion may be formed of a protrusion protruded from a top face of the mounting post provided on the body so that the protrusion engages each of the concave portions in the leaf spring with play and the second holding portion may be formed of a protrusion protruded downward from the inner face of the top wall of the cover so that the protrusion engages the concave portion in the leaf spring with play. Alternatively, the first holding portion may be formed of two opposing protrusions protruded upward from the top face of the mounting post provided on the body while the second holding portion may be formed of two opposing protrusions protruded downward from the inner face of the top wall of the cover so that the protrusions engage the convex portion in the leaf spring with play.

Preferably, the first holding portions provided on front and rear mounting posts on the body and the second holding portions provided on front and rear portions on an inner face of the top wall of the cover are disposed such that they are shifted from each other in a longitudinal direction when the body and the cover are assembled.

When the body and the cover are assembled with each other, space portions for eliminating interference between the body and the cover may be formed on respective opposing faces of each of the first holding portions provided on the mounting post of the body and each of the second holding portions provided on the inner face of the top wall of the cover.

Further preferably, one of the space portions is provided in the mounting post provided on the body so as to form a first accommodating portion for accommodating the second holding portion while another one is provided in an inner face of the top wall of the cover so as to form a second accommodating portion for accommodating the first holding portion.

The first holding portion provided on the mounting post of the body or the second holding portion provided on the inner face of the top wall of the cover may be so configured that a V-shaped groove is provided longitudinally in the center of the protrusion so that top portions of the protrusion are capable of being bent to the right and left sides and the concave portion in the leaf spring is engaged with the protrusion with play. Alternatively, the first holding portion or the second holding portion may be so configured that an expanded head is provided at a top end of the protrusion so that the concave portion in the leaf spring is engaged wit the protrusion with play. Further, the first holding portion or the second holding portion may have two opposing protrusions which are capable of holding the convex portion of the leaf spring therebetween with play and may be formed to be bent inward.

Further preferably, a first accommodating portion is provided on an outer side of the first holding portion provided in the mounting post on a front portion of the body; a recess for accommodating an end of the pawl member is provided on an inner side of the mounting post, the first accommodating portion is provided on an outer side of the first holding portion provided in the other mounting post on a rear portion of the body, a pawl hole for insertion of locking pawl is provided on an inner side of the mounting post, the second holding portions are provided on front and rear ends of an inner face of the top wall of the cover, the second accommodating portion is provided in a proximal portion of each of the second holding portions; the leaf spring is provided between the first and second holding portions and the cover is formed to be fixed to the mounting posts from above.

DESCRIPTION OF THE PREFERRED EMBODIMENTS

Hereinafter, an embodiment of a slider for slide fastener provided with an automatic stopper device of the invention will be described with reference to the accompanying drawings.

Figure 1:
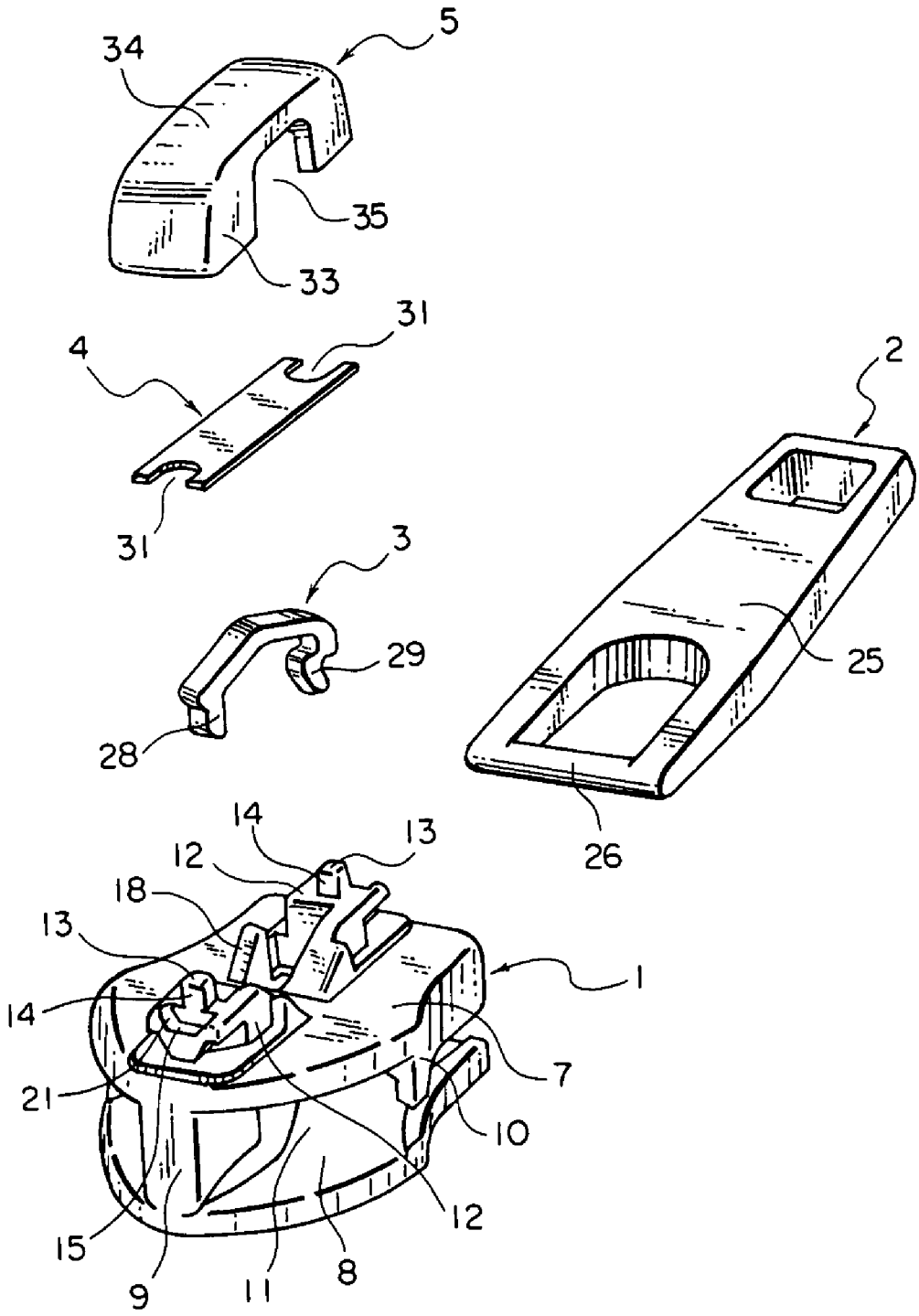
FIG. 1 is a disassembly perspective view of a slider provided with an automatic stopper device.
Figure 2:
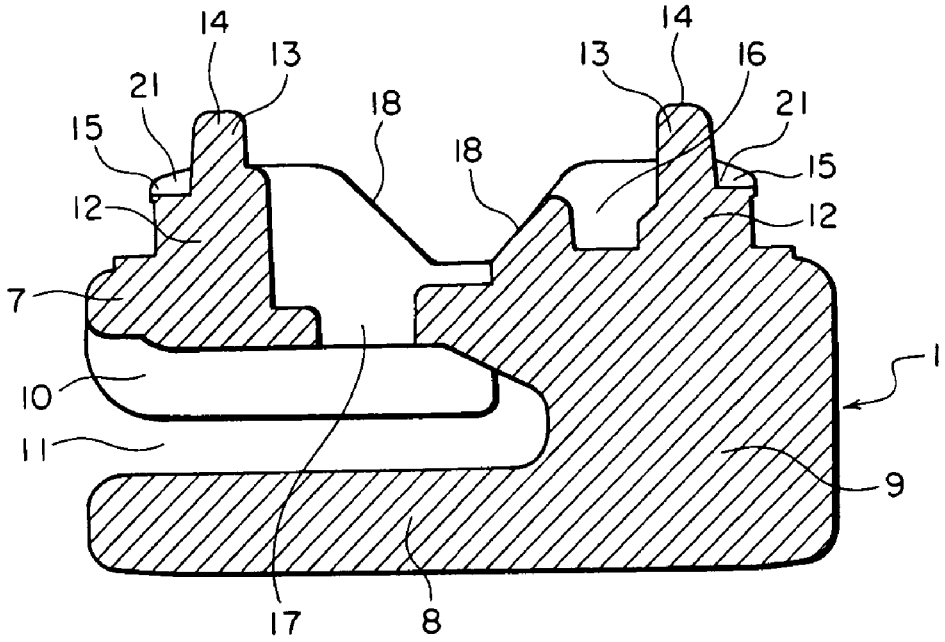
FIG. 2 is a sectional view of a slider body.

As shown in FIG. 1, the slider for slide fastener provided with an automatic stopper device of the invention comprises five members, that is, a body 1, a pull tag 2, a pawl member 3, a leaf spring 4 and a cover 5. These members are formed by die-casting aluminum alloy or zinc alloy or pressing brass, stainless steel or the like. Alternately, the body 1, the pull tag 2, the pawl member 3 and the cover 5 are formed by injection molding of synthetic resin such as polyamide, polyacetal, polypropylene and polybutylene terphthalate. Then, the five members are assembled to a slider having automatic stopper mechanism.

In the body 1, an upper blade 7 and a lower blade 9 are combined through a guide post 9. Guide flanges 10 for guiding fastener elements are provided on both sides of both or any one of the upper and lower blades 7, 8 and the guide flanges 10 bend downward or upward so as to form a guide groove 11 inside thereof. Mounting posts 12 for mounting the cover 5 are provided on a shoulder side and a rear side of the top surface of the upper blade 7. A protrusion 13 is provided on the top face of each of the mounting posts 12 so as to form a first holding portion 14 for holding the leaf spring 4.

Figure 7:
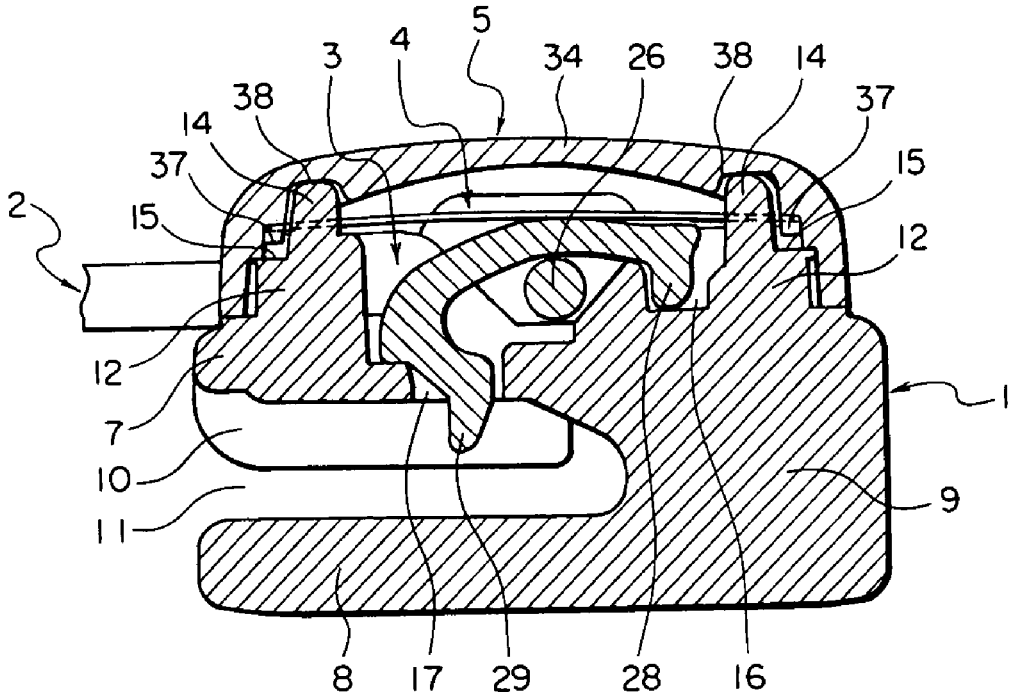
FIG. 7 is a sectional view of an assembled slider.
Figure 8:
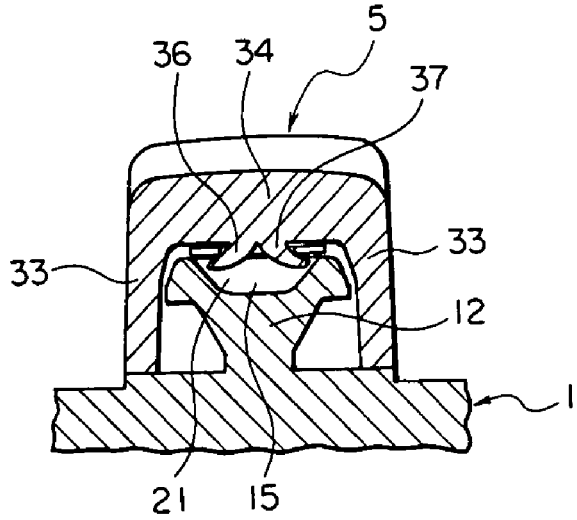
FIG. 8 is a sectional view of major portions showing a condition in which the protrusion of the cover is accommodated in an accommodating portion of a mounting post.
Figure 9:
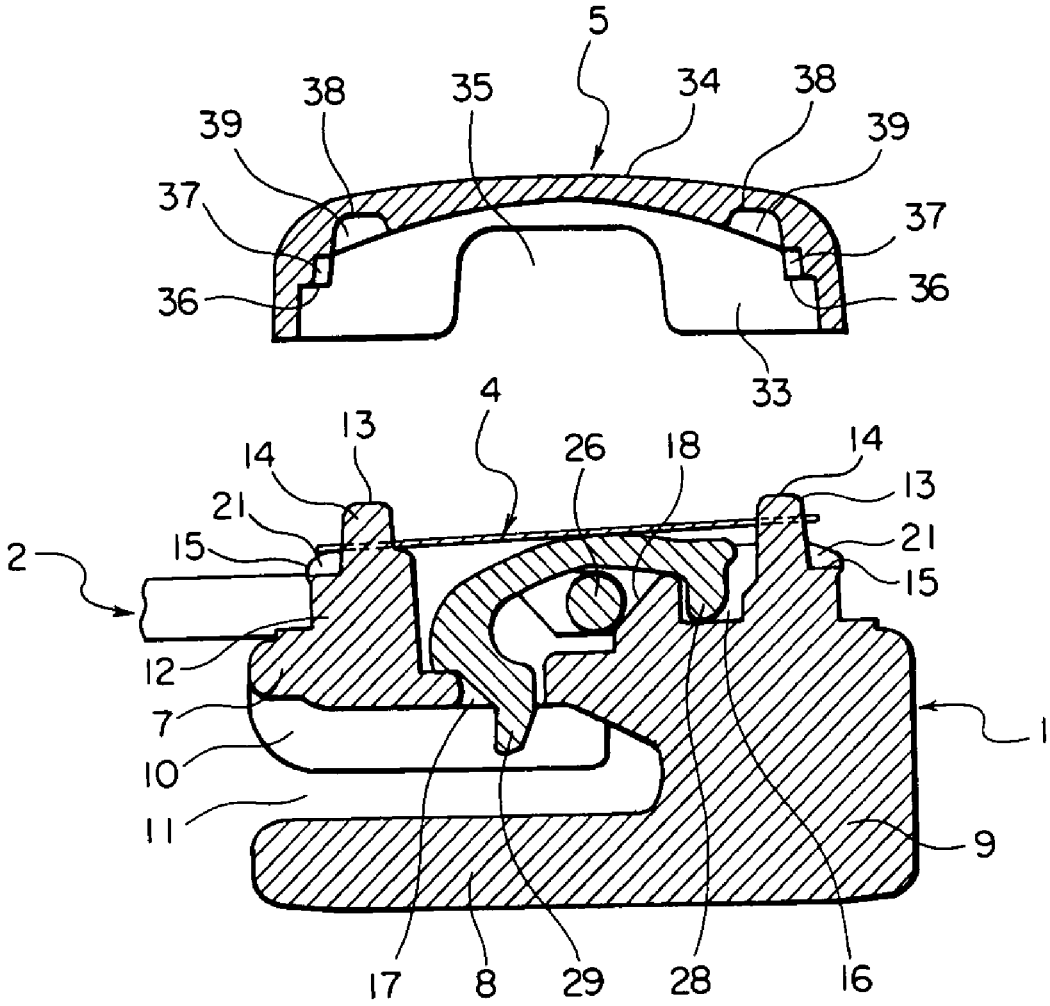
FIG. 9 is a sectional view showing a condition in which the leaf spring is placed on the mounting posts by automatic assembly procedure.
Figure 10:
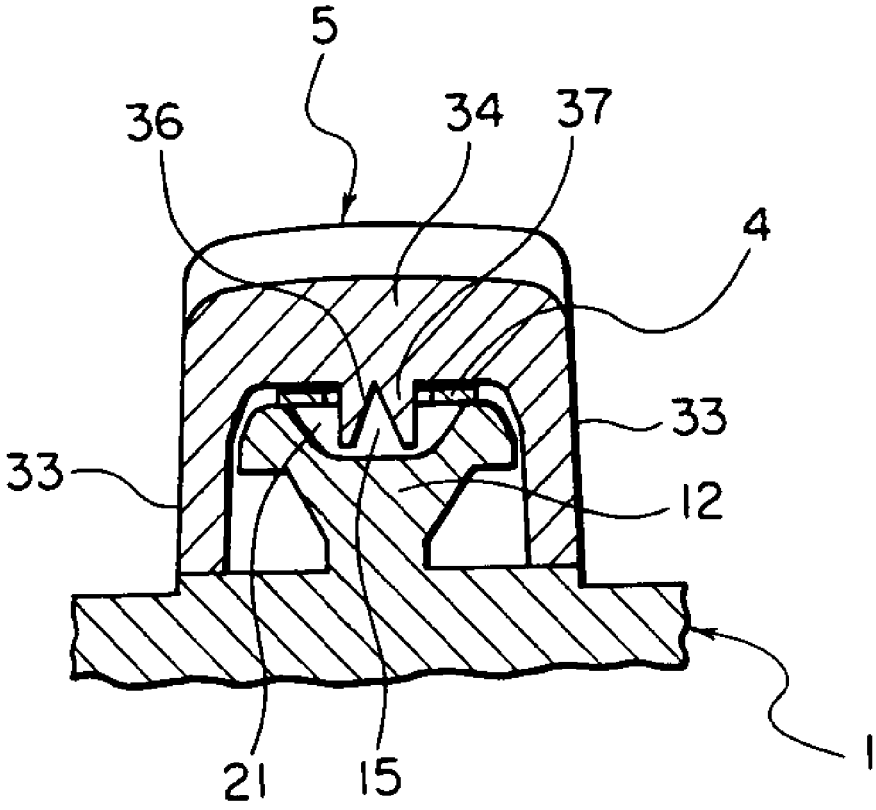
FIG. 10 is a sectional view of major portions showing a condition in which the protrusion of the cover is accommodated in the accommodating portion of the mounting post.

A concave space portion 21 is provided on the outer side of the first holding portion 14 provided in the mounting post 12 on the front side or the shoulder side of the body 1 so as to form a first accommodating portion 15, while the concave space portion 21 is provided on the outer side of the first holding portion 14 provided in the mounting post 12 on the rear side or the rear mouth side of the body 1 so as to form the first accommodating portion 15. Each of them accommodates a second holding portion 37 provided in the cover 5. With this configuration, as shown in FIGS. 7 and 9, the first holding portion 14 and second holding portion 37 are disposed so as to be shifted from each other in a longitudinal direction. As a result, the leaf spring 4 is effectively held and an elastic deformation thereof is effectively exerted. A recess 16 for accommodating an engagement protrusion 28 at an end of the pawl member 3 is provided on the proximal portion on the inner side of the mounting post 12, while a pawl hole 17 in which a locking pawl 29 provided on the other end of the pawl member 3 can be inserted loosely is provided on the proximal portion on the inner side of the rear mounting post 12. Slope portions 18 for guiding a pivoting shaft 26 of the pull tag 2 are integrally provided on the inner sides of the mounting posts 12 in the center on the top face of the upper blade 7 such that they oppose each other.

A grip portion 25 is provided on an end of the pull tag 2 while the pivoting shaft 26 is provided on the other end thereof and the pull tag 2 is mounted on the top face of the upper blade 7 rotatably. The engagement protrusion 28 which can be accommodated in the recess 16 provided in the body 1 is formed at an end of the pawl member 3 and a locking pawl 29 which can be inserted loosely into the pawl hole 17 provided in the body 1 is formed at the other end. The leaf spring 4 is formed of a rectangular plate and concave portions 31 are formed in both ends so that the first holding portion 14 provided on the mounting post 12 and the second holding portion 37 provided on an inner face of the top wall 34 of the cover 5 can be accommodated therein.

Figure 3:
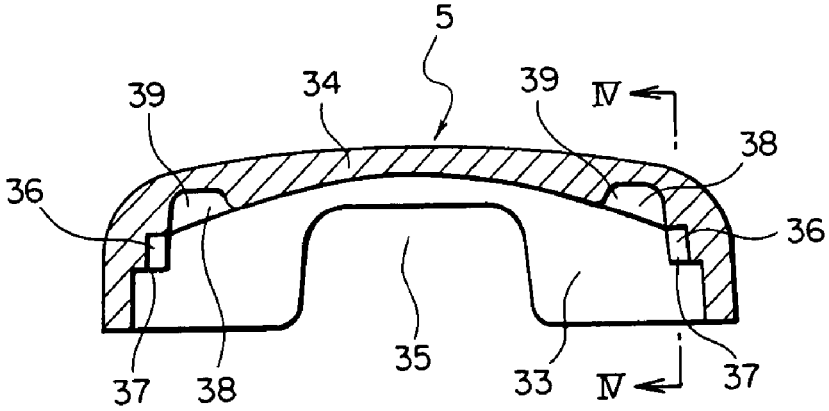
FIG. 3 is a sectional view of a cover.
Figure 4:
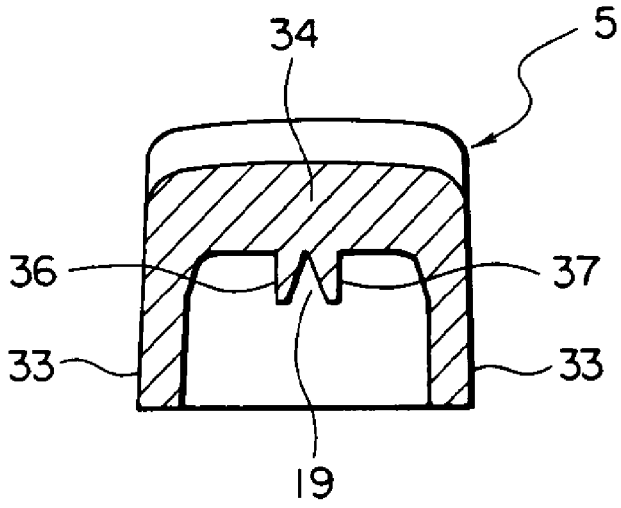
FIG. 4 is a sectional view taken along the line IV-IV of FIG. 3.
Figure 5:
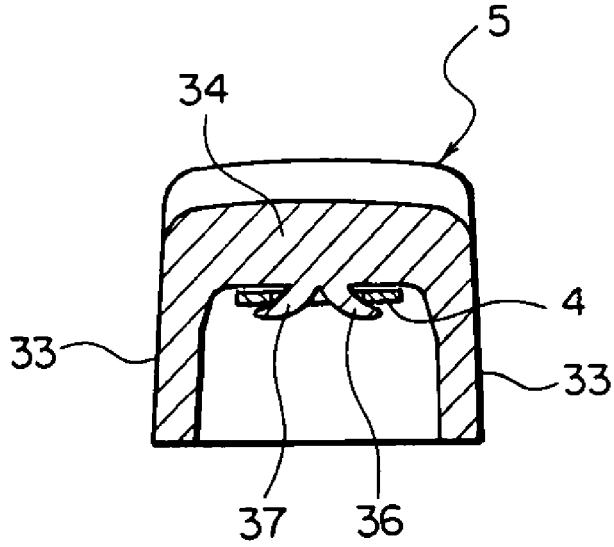
FIG. 5 is a sectional view showing a condition in which a protrusion is elastically deformed.

The cover 5 is formed in box type and one side thereof is open. Openings 35 are provided in both side walls 33 so that the pivoting shaft 26 of the pull tag 2 can be inserted through them. As shown in FIGS. 3 and 4, a protrusion 36 is provided at each of the front and rear ends of the inner face of the top wall 34 so as to form the second holding portions 37, which hold both ends of the leaf spring 4. A concave space portion in which the first holding portion 14 provided on the mounting post 12 can be inserted loosely is provided on each of the front and rear portions in the inner face of the top wall 34 adjacent to each of the second holding portions 37 so as to form the second accommodating portion 38. The protrusion 36 of the second holding portion 37 has a V-shaped groove 19 formed in the longitudinal direction in the center thereof as shown in FIG. 4 so as to be bent to the right and left sides. When bent, an end of the leaf spring 4 is held between the top wall 34 of the cover 5 and the protrusion 36 such that the leaf spring can move freely. The V-shaped groove 19 can be applied to the first holding portion 14 provided on the mounting post 12 also.

Figure 11:
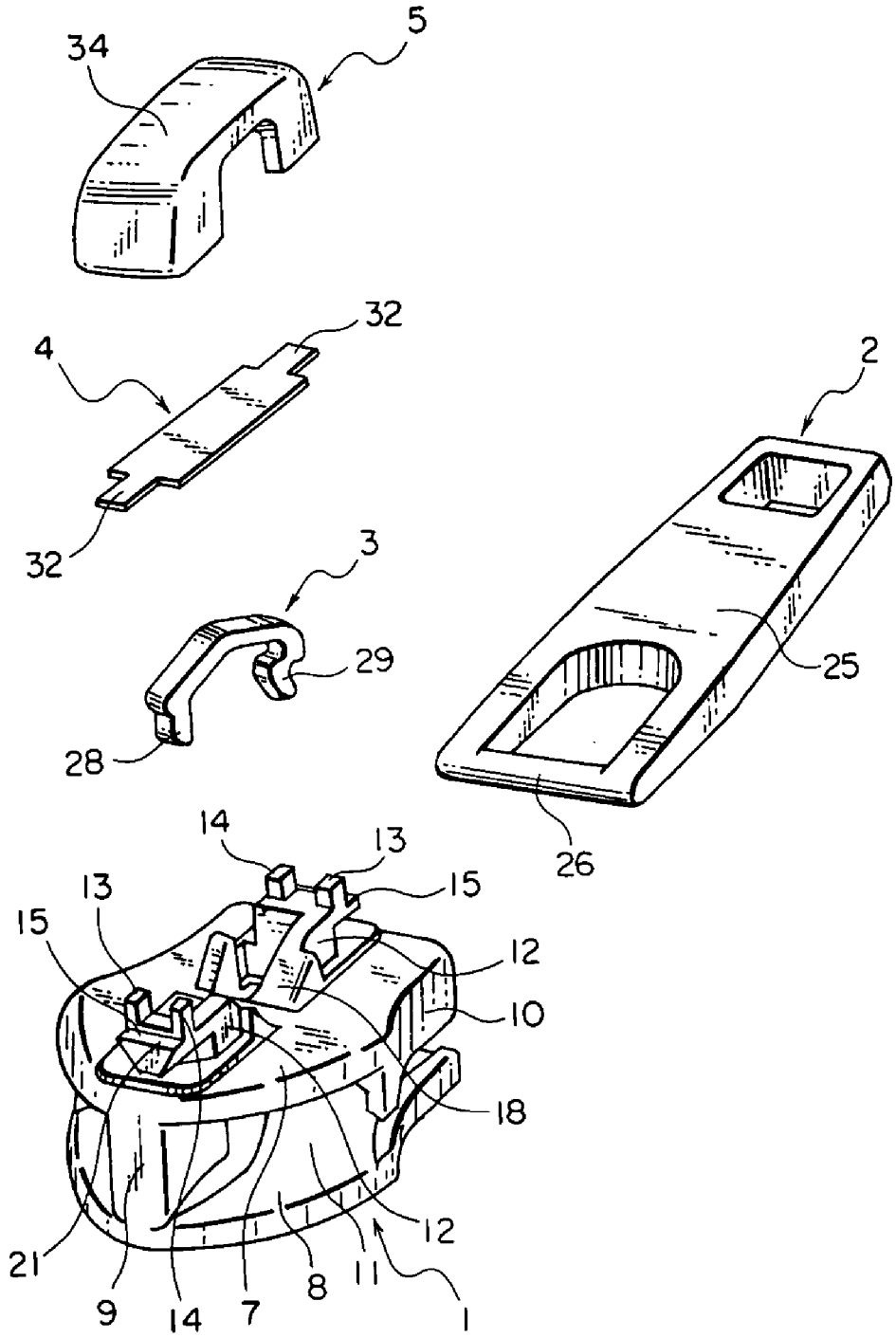
FIG. 11 is a disassembly perspective view of a slider according to a modification.
Figure 12:
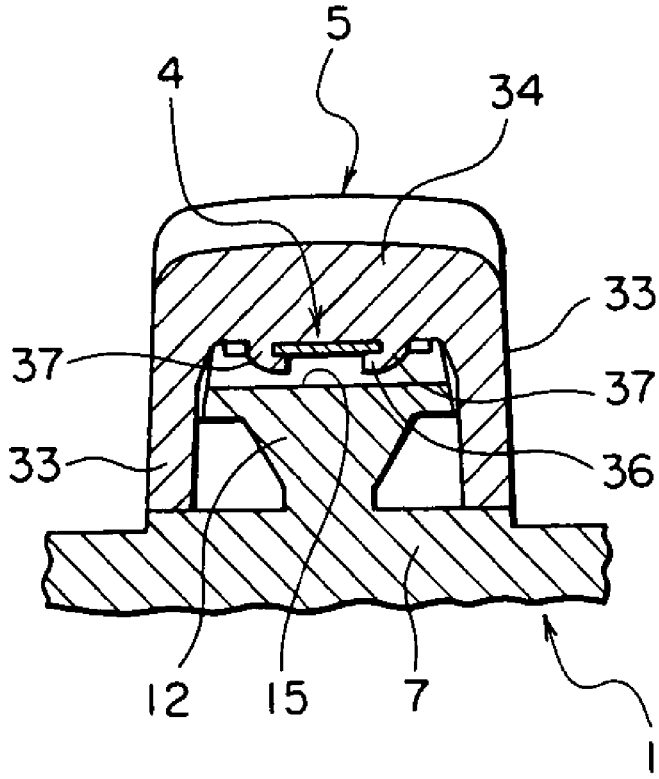
FIG. 12 is a sectional view of major portions showing a condition in which the protrusion of the cover in the modified slider is accommodated in the accommodating portion of the mounting post.

Modifications of the first holding portion 14, the second holding portion 37 and the leaf spring 4 will be described. As shown in FIGs. 11 and 12, two protrusions 13 are provided on the top face of the mounting post 12 of the body 1 such that they oppose each other across a gap so as to form the first holding portion 14. The first accommodating portion 15 provided on the outer side of the first holding portion 14 is not a concave space portion 21, but a space portion 21 provided therein by securing a difference in step with respect to the top face of the mounting post 12, that is, cutting out the top face of the mounting post 12 into a flat level so as to form the first accommodating portion 15. Two protrusions 36 are provided at each of the front and rear ends of the inner face of the top wall 34 of the cover 5 such that they oppose each other across a gap so as to form a second holding portion 37. A concave or flat second accommodating portion 38 for accommodating the first holding portion 14 provided on the mounting post 12 is formed on the inner side of the second holding portion 37 in the inner face of the top wall.

The leaf spring 4 has convex portions 32 on both ends thereof and the convex portions 32 are disposed and held in the gap between the protrusions 13 of the first holding portion 14 of the mounting post 12 and in the gap between the protrusions 36 of the second holding portion 37 provided on the inner face of the top wall 34 of the cover 5. At this time, the convex portions 32 provided on both ends of the leaf spring 4 may be embraced flexibly by the second holding portion 37 composed of the two protrusions 36 provided protrudedly on the inner face of the top wall 34 of the cover 5 as shown in FIG. 12. The leaf spring 4 may be embraced in a condition that the two protrusions 36 of the second holding portion 37 are bent or in a condition that the protrusions are not bent but remain protruded such that they oppose the first holding portion 14 of the mounting post 12. Further, it is possible to provide with directivity by forming an end of the leaf spring 4 into the concave portion 31 while the other end into the convex portion 32 and then by forming the first holding portion 14 of the mounting post 12 and the second holding portion 37 of the cover 5 to a shape corresponding to that of an end portion of the leaf spring 4.

Figure 13:
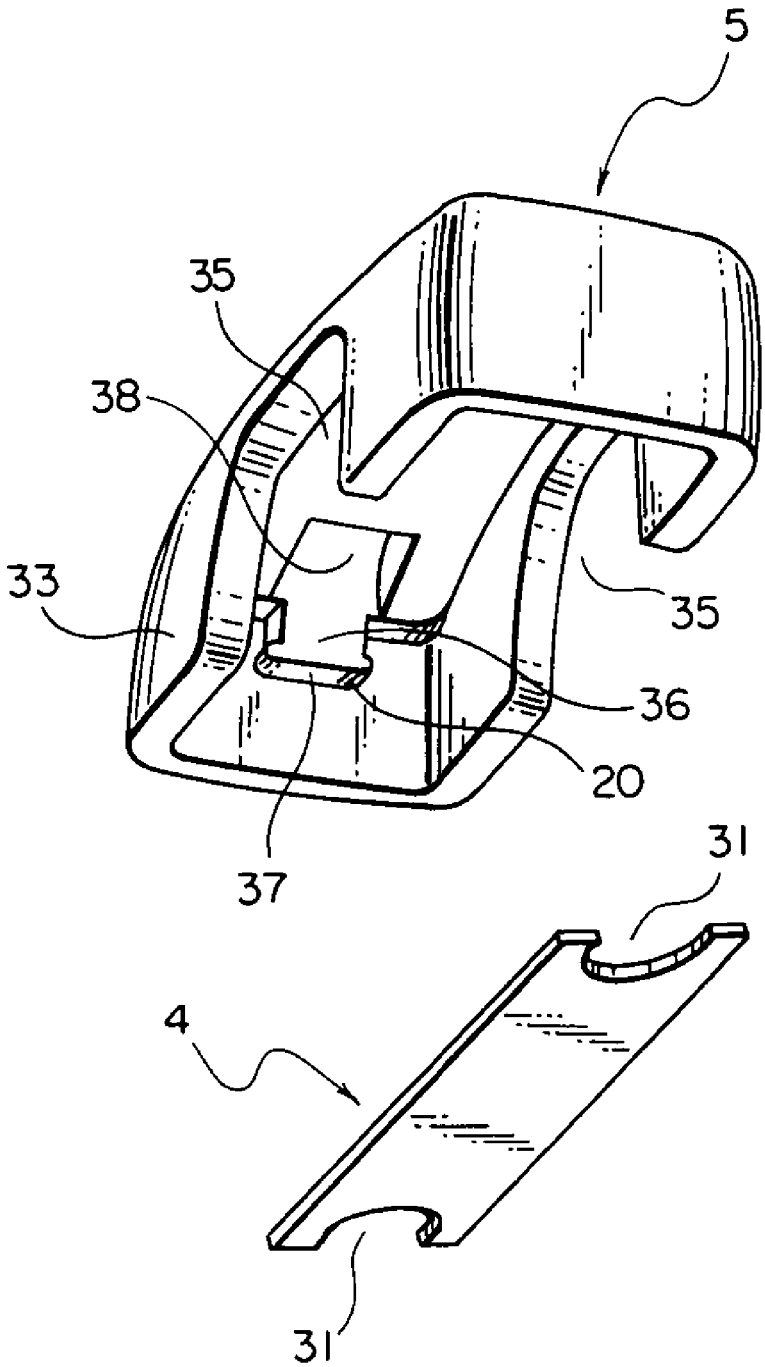
FIG. 13 is a perspective view showing the cover and leaf spring of another modification.
Figure 14:
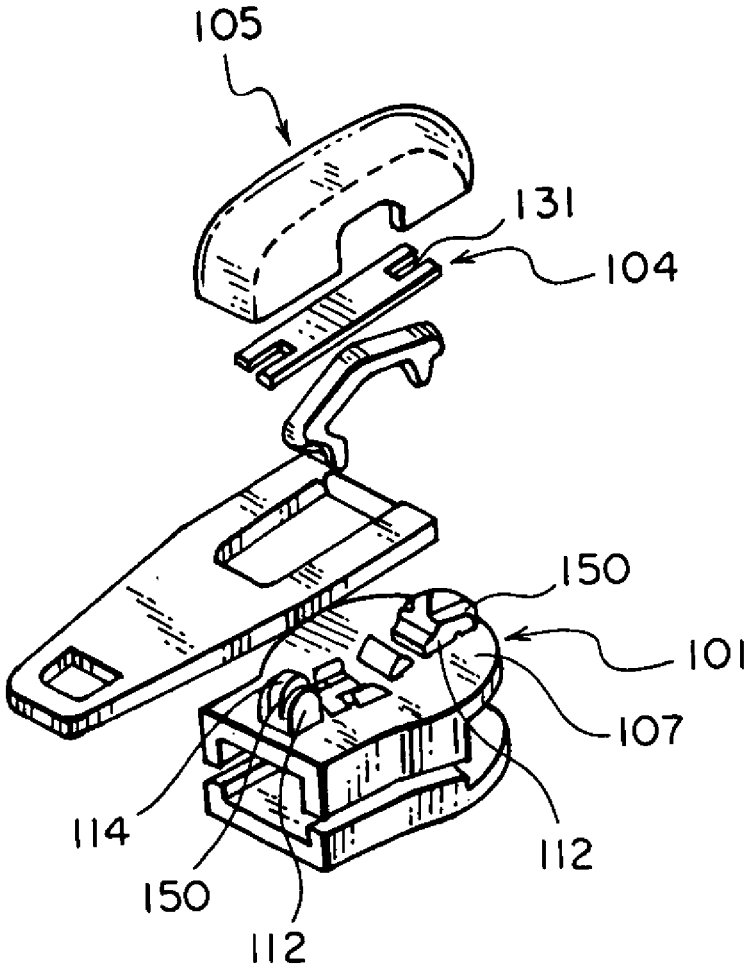
FIG. 14 PRIOR ART
FIG. 14 is a disassembly perspective view of a well known slider provided with an automatic stopper device.
Figure 15:
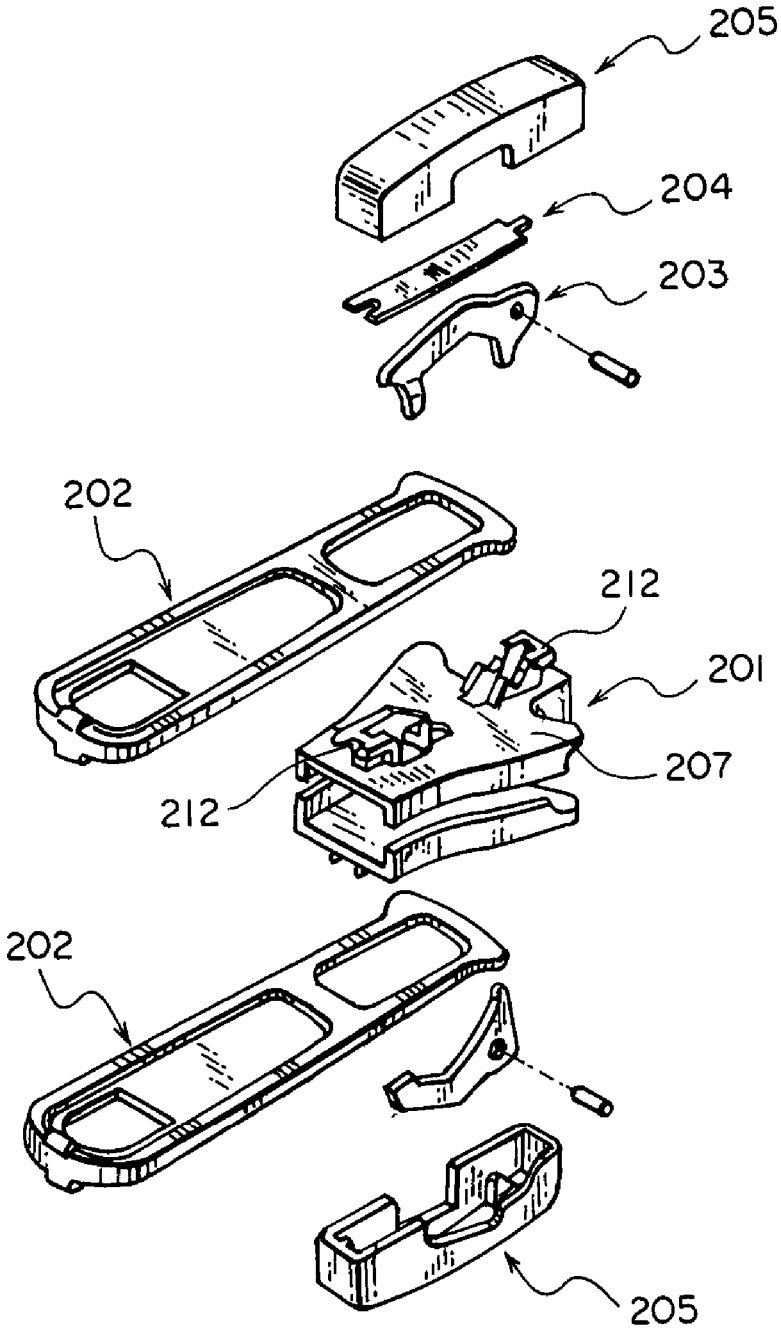
FIG. 15 PRIOR ART
FIG. 15 is a disassembly perspective view of another well known slider provided with an automatic stopper device.
Figure 16:
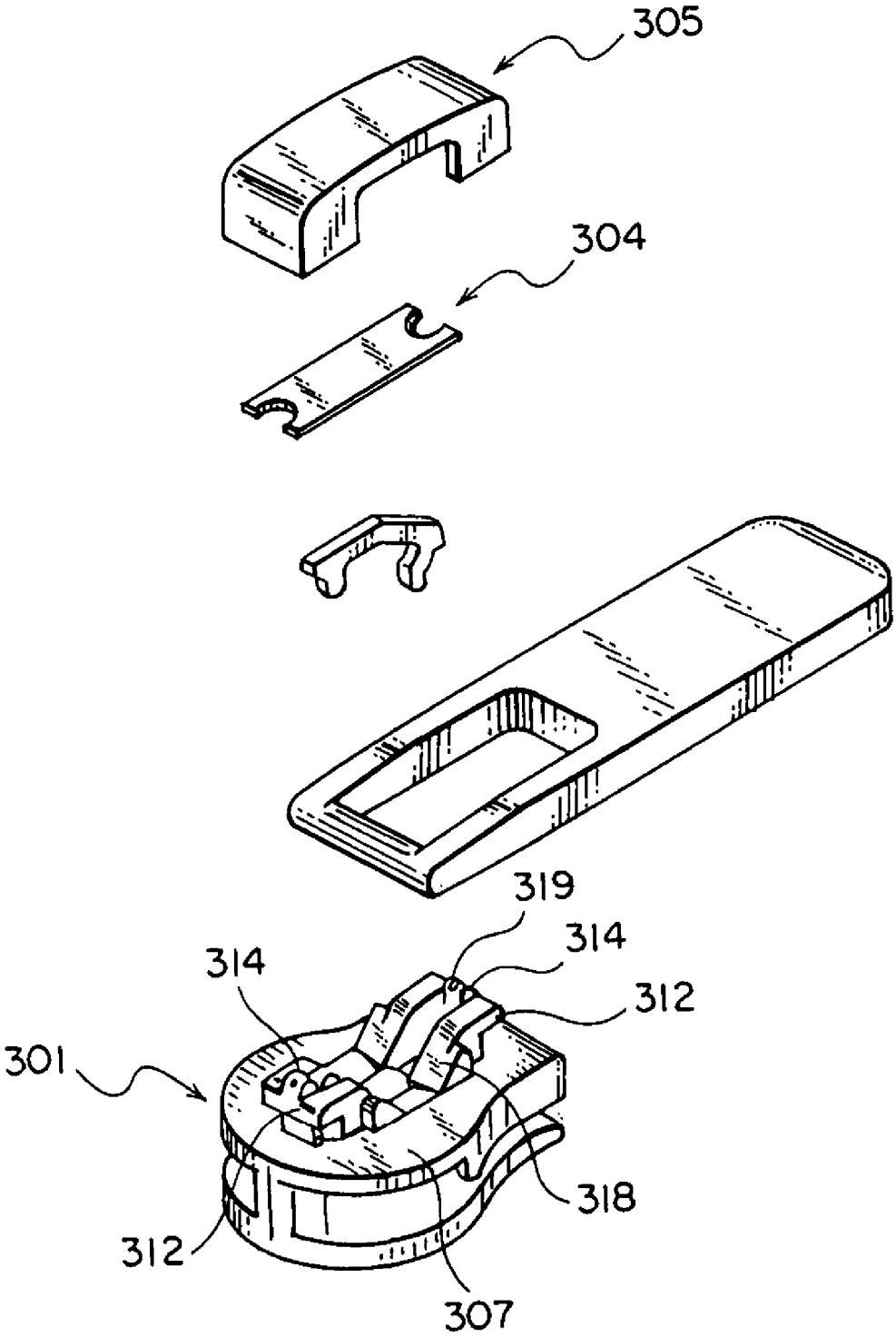
FIG. 16 PRIOR ART
FIG. 16 is a disassembly perspective view of still another slider provided with an automatic stopper device.

As shown in FIG. 13, both ends of the leaf spring 4 are provided with concave portions 31 with which both the protrusion 13 as the first holding portion 14 provided on a top face of the mounting post 12 erected from the body 1 and the protrusion 36 as the second holding portion 37 provided longitudinally on an inner face of the top wall 34 of the cover 5 can engage. The protrusion 36 provided on an inner face of the top wall 34 of the cover 5 has a head 20 whose width is expanded at its top end and each of the concave portions 31 of the leaf spring 4 is elastically deformed by the head 20 and engaged therewith. The expanded head 20 can be applied to the protrusion 13 of the mounting post 12. It is permissible to form the concave second accommodating portion 38 provided in an inner face of the top wall 34 of the cover 5 into a flat configuration so as to obtain the second accommodating portion 38.

If the slider is assembled using an automatic assembly unit, as shown in FIG. 9, the pivoting shaft 26 of the pull tag 2 is placed between the slope portions 18 provided on a top face of the body 1 and the engagement protrusion 28 of the pawl member 3 is inserted into the recess 16 and the locking pawl is inserted into the pawl hole 17. The leaf spring 4 is placed on the first holding portion 14 provided on a top face of each of the front and rear mounting posts 12 provided on the upper blade 7 of the body 1. At this time, with the pivoting shaft 26 of the pull tag 2 interposed between the leaf spring 4 and the slope portion 18 and the pawl member 3 placed thereon, the cover 5 is mounted so as to cover the mounting post 12 from above. The first holding portion 14 engages the second accommodating portion 38, while the second holding portion 37 engages the first accommodating portion 15 and then, by crimping the cover 5 onto the mounting posts 12, a slider provided with an automatic stopper device can be assembled.

Figure 6:
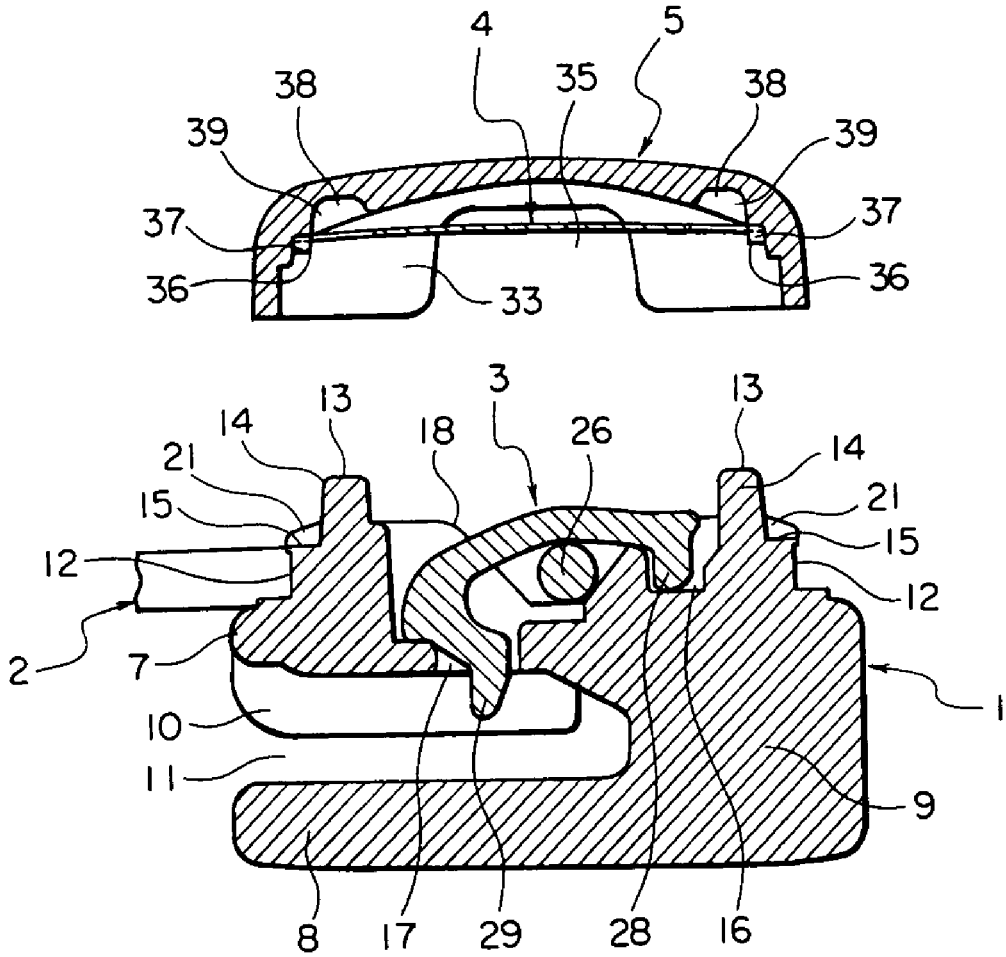
FIG. 6 is a sectional view showing a condition in which a leaf spring is held on the cover by manual assembly procedure.

In case of manual assembly, as shown in FIG. 6, the pivoting shaft 26 of the pull tag 2 is placed between the slope portions 18 provided on a top face of the body 1 and the engagement protrusion 28 of the pawl member 3 is inserted into the recess 16 while the locking pawl 29 is inserted into the pawl hole 17. The concave portion 31 in the leaf spring 4 is engaged with the second holding portion 37 of each of the protrusions 36 at front and rear ends on an inner face of the top wall 34 of the cover 5 and then, each of the protrusions 36 having the V-shaped groove 19 is bent to the right and left sides to hold the leaf spring 4. The cover 5 in this condition is placed on the mounting posts 12 and the first holding portion 14 engages the second accommodating portion 38 while the second holding portion 37 engages the first accommodating portion 15. By crimping the cover 5 onto the mounting posts 12, a slider provided with an automatic stopper device can be assembled.

In both automatic assembly and manual assembly, the protrusion 13 of the first holding portion 14 and the protrusion 36 of the second holding portion 37 are accommodated in the concave portion 31 in the leaf spring 4 in a longitudinal direction, so that elastic deformation of the leaf spring 4 is not blocked.

The slider for slide fastener provided with an automatic stopper device of the invention has the above-described structure and this structure ensures the following operation and effect specific to the invention.

The slider comprises a body 1, a pull tag 2, a pawl member 3, a leaf spring 4 and a cover 5, wherein mounting posts 12 are provided on front and rear portions of an upper blade 7 of the body 1, a first holding portion 14 for holding the leaf spring 4 is provided on the top face of each of the mounting posts 12, while second holding portions 37 for holding the leaf spring 4 are provided on front and rear portions of an inner face of the cover 5, the leaf spring 4 is provided between the respective holding portions 14 and 37 such that it can play freely, a pivoting shaft 26 of the pull tag 2 and a pawl member 3 are interposed between the leaf spring 4 and the upper blade 7 and the cover 1 is fixed on the mounting posts 12. Accordingly, the slider having the automatic stopper device can be assembled easily in both cases of automatic assembly and manual assembly. Because the leaf spring 4 in an assembled slider is held by the first holding portion 14 provided in the mounting post 12 and by the second holding portion 37 provided in the cover 5, it can be disposed in a very stabilized condition and further elastic function can be exerted smoothly.

The leaf spring 4 is provided with a concave portions 31 for accommodating both the first holding portion 14 and the second holding portion 37 at both ends of its rectangular plate or convex portions 32 for being accommodated in both the first holding portion 14 and the second holding portion 37. Accordingly, various kinds of the leaf spring 4 can be maintained in a stabilized condition without respective holding portions 14 and 37 interfering with each other regardless of the shape of the leaf spring 4, thereby ensuring a smooth elastic deformation.

The first holding portion 14 is formed of a protrusion 13 protruded from a top face of the mounting post 12 so that the protrusion 13 engages each of the concave portions 31 in the leaf spring 4 with play and the second holding portion 37 is formed of the protrusion 36 protruded from an inner face of the top wall 34 of the cover 5 so that the protrusion 36 engages the concave portion 31 in the leaf spring 4 with play. Or the first holding portion 14 is comprised of two opposing protrusions 13 protruded from a top face of the mounting post 12 so that the two protrusions 13 are engaged with each of the convex portions 32 in the leaf spring 4 with play and the second holding portion 37 is comprised of two opposing protrusions 36 protruded from an inner face of the top wall 34 of the cover 5 so that the protrusions 36 are engaged with the convex portion 32 in the leaf spring 4 with play. Consequently, the leaf springs 4 of various kinds of configuration can be held in the first holding portion 14 and the second holding portion 37 effectively in a stabilized condition, thereby ensuring a smooth elastic deformation.

Because the first holding portions 14 provided on front and rear mounting posts 12 on the body 1 and the second holding portions 37 provided on front and rear portions on an inner face of the top wall 34 of the cover 5 are disposed such that they are shifted from each other in a longitudinal direction when the body 1 and the cover 5 are assembled, the leaf spring 4 can be held effectively so as to execute its elastic deformation effectively.

The body 1 and the cover 5 form space portions 21 and 39 on respective opposing faces of the first holding portion 14 and the second holding portion 37 and one of the space portions 21 is provided in the mounting post 12 to form the first accommodating portion 15 for accommodating the second holding portion 37 while another one of the space portions 39 is provided in an inner face of the cover 5 to form the second accommodating portion 38 for accommodating the first holding portion 14. Accordingly, when the cover 5 and the body 1 are assembled, each respective holding portion makes no contact with the cover 5 or body 1 thereby providing no obstacle to the assembly. Consequently, the leaf spring 4 is held strongly in a stabilized condition thereby exerting an ideal elastic function.

The first holding portion 14 or the second holding portion 37 is so configured that a V-shaped groove 19 is provided longitudinally in the center of each of the protrusions 13 and 36 so as to be bent to the right and left sides and the concave portion 31 is engaged with the protrusions 13 and 36 with play or so configured that an expanded head 20 is provided at a top end of each of the protrusions 13 and 36 so that the concave portion 31 in the leaf spring 4 is engaged with each protrusion 13 or 36 with play or is provided with two protrusions 13 and 36, which oppose each other and are bendable inward with a convex portion 32 of the leaf spring 4 maintained between the protrusions 13 and 36 with play. Consequently, various kinds of the holding portions 14 and 37 maintain the leaf spring 4 securely without an easy slip-out thereof thereby ensuring a smooth elastic deformation.

A first accommodating portion 15 is provided on an outer side of the first holding portion 14 provided in the mounting post 12 on a front portion of the body 1, a recess 16 for accommodating an end of the pawl member 3 is provided on an inner side of the mounting post 12, the first accommodating portion 14 is provided on an outer side of the first holding portion 14 provided in the rear mounting post 12, a pawl hole 17 for insertion of locking pawl 29 is provided on an inner side of the mounting post 12, the second holding portions 37 are provided at front and rear ends of an inner face of the top wall 34 of the cover 5, the second accommodating portion 38 is provided in a proximal portion of each of the second holding portions 37, the leaf spring 4 is provided between the first and second holding portions 14 and 37 and the cover 5 is formed to be fixed to the mounting posts 12. Consequently, in a slider provided with an automatic stopper device using five members, that is, a body 1, a pull tag 2, a pawl member 3, a leaf spring 4 and a cover 5, the members can be ideally disposed, and automatic assembly or manual assembly procedure is remarkably easy.

What is claimed is:

1. A slider for slide fastener provided with an automatic stopper device, the slider comprising a body, a pull tag, a pawl member, a leaf spring and a cover, wherein mounting posts are provided on front and rear portions of an upper blade of the body, first holding portions for holding the leaf spring are provided on the top faces of the mounting posts, second holding portions for holding the leaf spring are provided on front and rear portions of an inner face of the cover, front and rear end portions of the leaf spring are held between each of the first and second holding portions so that the spring bridges therebetween, a pivoting shaft of the pull tag and a pawl member are interposed between the leaf spring and the upper blade, the cover is fixed on the mounting posts, the leaf spring has a concave portion for accommodating one of the first holding portions and one of the second holding portions at least at an end of a rectangular plate, and the first holding portion is formed of a protrusion protruded from a top face of each of the mounting posts so that the protrusion engages the concave portion in the leaf spring with play and the second holding portion is formed of a protrusion protruded from an inner face of a top wall of the cover so that the protrusion engages the concave portion in the leaf spring with play.

2. The slider for slide fastener provided with an automatic stopper device according to claim 1, wherein the first holding portions provided on front and rear mounting posts on the body and the second holding portions provided on front and rear portions on an inner face of a top wall of the cover are disposed such that the first holding portions and the second holding portions are shifted from each other in a longitudinal direction when the body and the cover are assembled.

3. The slider for slide fastener provided wit an automatic stopper device according to claim 1, wherein the body and the cover are so configured that space portions are formed on respective opposing faces of each of the first holding portions disposed in the body and each of the second holding portions disposed in the cover.

4. The slider for slide fastener provided with an automatic stopper device according to claim 3, wherein one of the space portions is provided in one of the mounting posts of the body so as to form a first accommodating portion for accommodating the second holding portion while another one of the space portions is provided in an inner face of the cover so as to form a second accommodating portion for accommodating the first holding portion.

5. The slider for slide fastener provided with an automatic stopper device according to claim 3, wherein the first holding portion or the second holding portion is so configured that a V-shaped groove is provided longitudinally in the center of each of the protrusions so as to be bent to the right and left sides and the concave portion are engaged with each protrusion with play.

6. The slider for slide fastener provided with an automatic stopper device according to claim 1, wherein the first holding portion or the second holding portion is so configured that an expanded head is provided at a top end of each of the protrusions so that the concave portion in the leaf spring is engaged with each protrusion with play.

7. The slider for slide fastener provided with an automatic stopper device according to claim 1, wherein a first accommodating portion is provided on an outer side of one of the first holding portions provided in one of the mounting posts on a front portion of the body, a recess for accommodating an end of the pawl member is provided on an inner side of the one mounting post, the first accommodating portion is provided on an outer side of the other one of the first holding portions provided in the other one of the mounting posts on a rear portion of the body, a pawl hole for insertion of a locking pawl is provided on an inner side of the other mounting post, the second holding portions are provided at front and rear ends of an inner face of a top wall of the cover, a second accommodating portion is provided in a proximal portion of each of the second holding portions, the leaf spring is provided between the first and second holding portions and the cover is formed so as to be fixed to the mounting posts.

8. A slider for slide fastener provided with an automatic stopper device, the slider comprising a body, a pull tag, a pawl member, a leaf spring and a cover, wherein mounting posts are provided on front and rear portions of an upper blade of the body, first holding portions for holding the leaf spring are provided on the top faces of the mounting posts, second holding portions for holding the leaf spring are provided on front and rear portions of an inner face of the cover, front and rear end portions of the leaf spring are held between each of the first and second holding portions so that the spring bridges therebetween, a pivoting shaft of the pull tag and a pawl member are interposed between the leaf spring and the upper blade, the cover is fixed on the mounting posts, wherein the leaf spring has a convex portion for being accommodated in one of the first holding portions and one of the second holding portions at least at an end of a rectangular plate.

the first holding portion is comprised of two opposing protrusions protruded from a top face of each of the mounting posts so that the two protrusions are engaged with the convex portion in the leaf spring with play and the second holding portion is comprised of two opposing protrusions protruded from an inner face of a top wall of the cover so that the two protrusions are engaged with the convex portion in the leaf spring with play.

9. The slider for slide fastener provided with an automatic stopper device according to claim 8, wherein the first holding portion or the second holding portion has two protrusions which are provided such that they oppose each other and bendable inward with a convex portion of the leaf spring maintained between the protrusions with play.

10. The slider for slide fastener provided with an automatic stopper device according to claim 8, wherein the body and the cover are so configured that space portions are formed on respective opposing faces of each of the first holding portions disposed in the body and each of the second holding portions disposed in the cover.

11. The slider for slide fastener provided with an automatic stopper device according to claim 10, wherein one of the space portions is provided in one of the mounting posts of the body so as to form a first accommodating portion for accommodating the second holding portion while another one of the space portions is provided in an inner face of the cover so as to form a second accommodating portion for accommodating the first holding portion.

12. The slider for slide fastener provided with an automatic stopper device according to claim 10, wherein the first holding portion or the second holding portion is so configured that a V-shaped groove is provided longitudinally in the center of each of the protrusions so as to be bent to the right and left sides and the concave portion are engaged with each protrusion with play.

13. The slider for slide fastener provided with an automatic stopper device according to claim 8, wherein a first accommodating portion is provided on an outer side of one of the first holding portions provided in one of the mounting posts on a front portion of the body, a recess for accommodating an end of the pawl member is provided on an inner side of the one mounting post, the first accommodating portion is provided on an outer side of the other one of the first holding portions provided in the other one of the mounting posts on a rear portion of the body, a pawl hole for insertion of a locking pawl is provided on an inner side of the other mounting post, the second holding portions are provided at front and rear ends of an inner face of a top wall of the cover, a second accommodating portion is provided in a proximal portion of each of the second holding portions, the leaf spring is provided between the first and second holding portions and the cover is formed so as to be fixed to the mounting posts.

* * * * *